US009322078B2

(12) United States Patent
Sipilä

(10) Patent No.: US 9,322,078 B2
(45) Date of Patent: Apr. 26, 2016

(54) METHOD OF FEEDING FUEL GAS INTO THE REACTION SHAFT OF A SUSPENSION SMELTING FURNACE AND A CONCENTRATE BURNER

(75) Inventor: Jussi Sipilä, Espoo (FI)

(73) Assignee: Outotec Oyj, Espoo (FI)

( * ) Notice: Subject to any disclaimer, the term of this patent is extended or adjusted under 35 U.S.C. 154(b) by 530 days.

(21) Appl. No.: 13/502,522

(22) PCT Filed: Oct. 19, 2010

(86) PCT No.: PCT/FI2010/050810
§ 371 (c)(1),
(2), (4) Date: Apr. 17, 2012

(87) PCT Pub. No.: WO2011/048263
PCT Pub. Date: Apr. 28, 2011

(65) Prior Publication Data

US 2012/0228811 A1 Sep. 13, 2012

(30) Foreign Application Priority Data

Oct. 19, 2009 (FI) ..... 20096071

(51) Int. Cl.
*F27D 3/00* (2006.01)
*F27D 3/16* (2006.01)
(Continued)

(52) U.S. Cl.
CPC ... *C22B 5/14* (2013.01); *C22B 5/12* (2013.01); *C22B 15/00* (2013.01); *F27B 15/10* (2013.01); *F27B 15/14* (2013.01); *F27D 3/16* (2013.01); *F27D 3/18* (2013.01)

(58) Field of Classification Search
CPC ..... F27D 3/16; F27D 3/18; C22B 15/00; C22B 5/12
USPC ..... 266/221, 267, 216, 44, 200, 167, 182, 266/176; 75/455, 707, 454, 640, 652
See application file for complete search history.

(56) References Cited

U.S. PATENT DOCUMENTS

| | | | | |
|---|---|---|---|---|
| 4,493,732 | A | 1/1985 | Melcher | |
| 4,654,077 | A * | 3/1987 | Pusateri et al. | 423/619 |
| 4,848,754 | A | 7/1989 | Kemori | |
| 5,042,964 | A | 8/1991 | Gitman | |
| 5,181,955 | A | 1/1993 | Asteljoki | |
| 5,358,222 | A | 10/1994 | Kaasinen | |

(Continued)

FOREIGN PATENT DOCUMENTS

| | | |
|---|---|---|
| FI | 20031402 | 3/2005 |
| JP | 60248832 | 12/1985 |

OTHER PUBLICATIONS

Marko Keranen, International Search Report for PCT/FI2010/050810, Feb. 11, 2011.

*Primary Examiner* — Scott Kastler
*Assistant Examiner* — Michael Aboagye
(74) *Attorney, Agent, or Firm* — Chernoff, Vilhauer, McClung & Stenzel, LLP

(57) ABSTRACT

The invention relates to a method of feeding a fuel gas into the reaction shaft of a suspension smelting furnace and to a concentrate burner for feeding a reaction gas and fine solid matter into the reaction shaft of the suspension smelting furnace. In the method, fuel gas (16) is fed by the concentrate burner (4) to constitute part of the mixture formed by the pulverous solid matter (6) and the reaction gas (5), so that a mixture containing the pulverous solid matter (6), reaction gas (5) and fuel gas (6) is formed in the reaction shaft (2). The concentrate burner (4) comprises fuel gas feeding equipment (15) for adding the fuel gas (16) to constitute part of the mixture that is formed by fine solid matter (6) and reaction gas (5).

3 Claims, 3 Drawing Sheets

(51) Int. Cl.

| | |
|---|---|
| ***C22B 5/14*** | (2006.01) |
| ***C22B 5/12*** | (2006.01) |
| ***C22B 15/00*** | (2006.01) |
| ***F27D 3/18*** | (2006.01) |
| ***F27B 15/10*** | (2006.01) |
| ***F27B 15/14*** | (2006.01) |

(56) References Cited

U.S. PATENT DOCUMENTS

| | | | |
|---|---|---|---|
| 5,362,032 | A | 11/1994 | Ranki |
| 5,542,361 | A | 8/1996 | Lilja |
| 6,238,457 | B1 | 5/2001 | Holmi |
| 2010/0207307 | A1 | 8/2010 | Sipilae |

* cited by examiner

METHOD OF FEEDING FUEL GAS INTO THE REACTION SHAFT OF A SUSPENSION SMELTING FURNACE AND A CONCENTRATE BURNER

This is a national stage application filed under 35 USC 371 based on International Application No. PCT/FI2010/050810 filed Oct. 19, 2010, and claims priority under 35 USC 119 of Finnish Patent Application No. 20096071 filed Oct. 19, 2009.

BACKGROUND OF THE INVENTION

The object of the invention comprises a method of feeding a fuel gas into the reaction shaft of a suspension smelting furnace.

The invention also relates to a concentrate burner for feeding a reaction gas and fine-grained solid matter into the reaction shaft of the suspension smelting furnace.

The invention also relates to use of the method and the concentrate burner.

The invention relates to the method that takes place in the suspension smelting furnace, such as a flash smelting furnace, and to the concentrate burner for feeding the reaction gas and fine-grained solid matter into the reaction shaft of the suspension smelting furnace, such as the flash smelting furnace.

The flash smelting furnace comprises three main sections: a reaction shaft, a lower furnace and an uptake. In the flash smelting process, the pulverous solid matter that comprises a sulphidic concentrate, a slag forming agent and other pulverous components is mixed with the reaction gas by means of the concentrate burner in the upper part of the reaction shaft. The reaction gas may comprise air, oxygen or oxygen-enriched air. The concentrate burner comprises normally a feeder pipe for feeding the fine solid matter into the reaction shaft, where the orifice of the feeder pipe opens to the reaction shaft. The concentrate burner further comprises normally a dispersing device, which is arranged concentrically inside the feeder pipe and which extends to a distance from the orifice of the feeder pipe inside the reaction shaft and which comprises dispersing gas openings for directing a dispersing gas to the fine solid matter that flows around the dispersing device. The concentrate burner further normally comprises a gas supply device for feeding the reaction gas into the reaction shaft, the gas supply device opening to the reaction shaft through an annular discharge opening that surrounds the feeder pipe concentrically for mixing the said reaction gas that discharges from the annular discharge opening with the fine solid matter, which discharges from the middle of the feeder pipe and which is directed to the side by means of the dispersing gas. The flash smelting process comprises a stage, wherein the fine solid matter is fed into the reaction shaft through the orifice of the feeder pipe of the concentrate burner. The flash smelting process further comprises a stage, where the dispersing gas is fed into the reaction shaft through the dispersing gas openings of the dispersing device of the concentrate burner for directing the dispersing gas to the fine solid matter that flows around the dispersing device, and a stage, where the reaction gas is fed into the reaction shaft through the annular discharge opening of the gas supply device of the concentrate burner for mixing the reaction gas with the solid matter, which discharges from the middle of the feeder pipe and which is directed to the side by means of the dispersing gas.

In most cases, the energy needed for the melting is obtained from the mixture itself, when the components of the mixture that is fed into the reaction shaft, the pulverous solid matter and the reaction gas react with each other. However, there are raw materials, which do not produce enough energy when reacting with each other and which, for a sufficient melting, require that fuel gas is also fed into the reaction shaft to produce energy for the melting. After production breaks, it may also be necessary to temporarily bring more energy in the form of fuel gas to the reaction shaft to properly initiate the reactions. For the time of production breaks, it may also be necessary to temporarily bring more energy in the form of fuel gas to the reaction shaft to maintain the temperature in the reaction shaft.

Various solutions are known for feeding the fuel gas into the reaction shaft.

In a known solution, the fuel gas is fed through a channel, which runs in the middle of the dispersing device of the concentrate burner, directly downwards into the reaction shaft. The disadvantages of this solution are its weak and local performance in the reaction shaft.

In another known solution, the fuel gas is fed into the reaction shaft through separate fuel gas feeding members that are arranged in the inner structure of the reaction shaft or attached to the reaction shaft itself. One disadvantage of this solution is that the separate fuel gas feeding members cause point-form thermal stress to the structure of the reaction shaft in the spot, wherein the separate fuel gas feeding member is arranged, and the point-form thermal stress wears the structures of the reaction shaft.

The patent specification WO 2009/030808 presents a concentrate burner.

SHORT DESCRIPTION OF THE INVENTION

The object of the invention is to solve the problems mentioned above.

In the solution according to the invention, fuel gas is fed by the concentrate burner such as to constitute a part of the mixture that is formed from pulverous solid matter and reaction gas, so that a mixture containing pulverous solid matter, reaction gas and fuel gas is formed in the reaction shaft.

The solution according to the invention enables the formation of a symmetric flame in the reaction shaft. This is due to the fact that fuel gas is added and mixed to constitute a component in the mixture formed by reaction gas and pulverous solid matter, which mixture the concentrate burner is adapted to distribute, i.e., symmetrically blow into the reaction shaft.

The solution according to the invention enables a steadier distribution of the thermal energy originating from the fuel gas in the reaction shaft, so that no local thermal stress peaks are allowed to be generated. This is due to the fact that fuel gas is added and mixed to constitute a component in the mixture formed by reaction gas and pulverous solid matter, which mixture the concentrate burner is adapted to distribute, i.e., symmetrically blow into the reaction shaft.

The solution according to the invention further enables focusing the thermal energy originating from the fuel gas more accurately to where the thermal energy originating from the fuel gas is needed, such as introducing extra thermal energy into the reaction between the reaction gas and the pulverous solid matter.

In a solution according to the invention, fuel gas is fed through the dispersing gas openings of the dispersing device of the concentrate burner, so that dispersing gas that is fed at least partly or fully consists of fuel gas. This avoids, e.g., making any extra changes in the concentrate burner that is used. The dispersing gas that contains or consists of fuel gas blows the pulverous solid matter to the side and pulverous solid matter is mixed with reaction gas. Therefore, the fuel gas, pulverous solid matter and reaction gas do not form an inflammable mixture until at a distance from the concentrate burner and there is no danger of the mixture catching fire in the channels of the concentrate burner. When fuel gas is well mixed with pulverous solid matter and reaction gas in the reaction shaft, the mixture forms a stable flame, the width of which is adjustable by the same methods that are normally used to adjust the operation of the concentrate burner.

LIST OF FIGURES

In the following, some preferred embodiments of the invention are described in detail with reference to the appended figures, wherein.

DETAILED DESCRIPTION OF THE INVENTION

Figure 1:
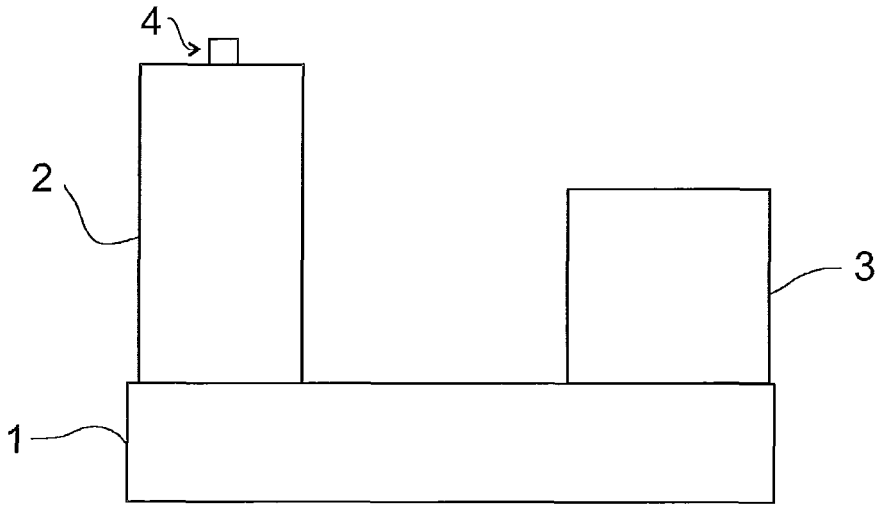
PRIOR ART FIG1
FIG. 1 is a basic figure of the suspension smelting furnace, in the reaction shaft of which the concentrate burner is arranged.

FIG. 1 shows the suspension smelting furnace comprising a lower furnace 1, reaction shaft 2 and uptake 3. The concentrate burner 4 is adapted in the reaction shaft 2. The operating principle of such a smelting furnace known as such is disclosed in the patent specification U.S. Pat. No. 2,506,557, for example.

The invention firstly relates to the concentrate burner 4 for feeding reaction gas 5 and fine solid matter 6 into the reaction shaft 2 of the suspension smelting furnace. The reaction gas 5 can be, for example, oxygen-enriched air or it can contain oxygen-enriched air. The fine solid matter can be, for example, a copper or nickel concentrate.

The concentrate burner 4 comprises a fine solid matter supply device 21 for feeding fine solid matter 6 into the reaction shaft 2 and a gas supply device 12 for feeding reaction gas 5 into the reaction shaft 2. The concentrate burner 4 comprises also fuel gas feeding equipment 15 for feeding fuel gas 2 into the reaction shaft 2 such as for adding fuel gas 16 to constitute part of the mixture that is formed in the reaction shaft by fine solid matter 6 and reaction gas 5.

The concentrate burner 4 may comprise fuel gas feeding equipment 15 for feeding fuel gas 16 into the fine solid matter supply device 21 for feeding fuel gas 16 with the fine solid matter supply device 21 into the reaction shaft 2.

The concentrate burner 4 may comprise fuel gas feeding equipment 15 for feeding fuel gas 16 into the gas supply device 12 for feeding fuel gas 16 with the gas supply device 12 into the reaction shaft 2.

The concentrate burner 4 may comprise a dispersing device 9 for directing a stream of dispersing gas 11 towards fine solid matter 6 in the reaction shaft 2 for directing fine solid matter 6 towards reaction gas 5 in the reaction shaft 2 and fuel gas feeding equipment 15 for feeding fuel gas 16 into the dispersing device 9 for feeding fuel gas 16 into the reaction shaft 2 with the dispersing device 9.

In FIGS. 2 to 6, the fine solid matter supply device 21 of the concentrate burner 4 comprises a feeder pipe 7 for feeding fine solid matter into the reaction shaft 2, the orifice 8 of the feeder pipe opening to the reaction shaft 2.

In FIGS. 2 to 6, the concentrate burner 4 further comprises a dispersing device 9, which is arranged concentrically inside the feeder pipe 7 and extends to a distance from the orifice 8 of the feeder pipe inside the reaction shaft 2. The dispersing device 9 comprises dispersing gas openings 10 for directing dispersing gas 11 around the dispersing device 9 and to fine solid matter that flows around the dispersing device 9.

In FIGS. 2 to 6, the concentrate burner 4 further comprises a gas supply device 12 for feeding reaction gas 5 into the reaction shaft 2. The gas supply device 12 comprises a reaction gas chamber 13, which is arranged outside the reaction shaft 2 and which opens to the reaction shaft 2 through the annular discharge opening 14 that concentrically surrounds the feeder pipe 7 for mixing reaction gas 5 discharging from the discharge opening with fine solid matter 6 that discharges from the middle of the feeder pipe 7, said solid matter being directed to the side by means of the dispersing gas 11.

In FIGS. 2 to 6, the concentrate burner 4 further comprises fuel gas feeding equipment 15 for adding fuel gas 16 to constitute part of the mixture 20 that is formed by fine solid matter 6 that discharges from the orifice 8 of the feeder pipe and reaction gas 5 that discharges through the annular discharge opening 14.

Figure 2:
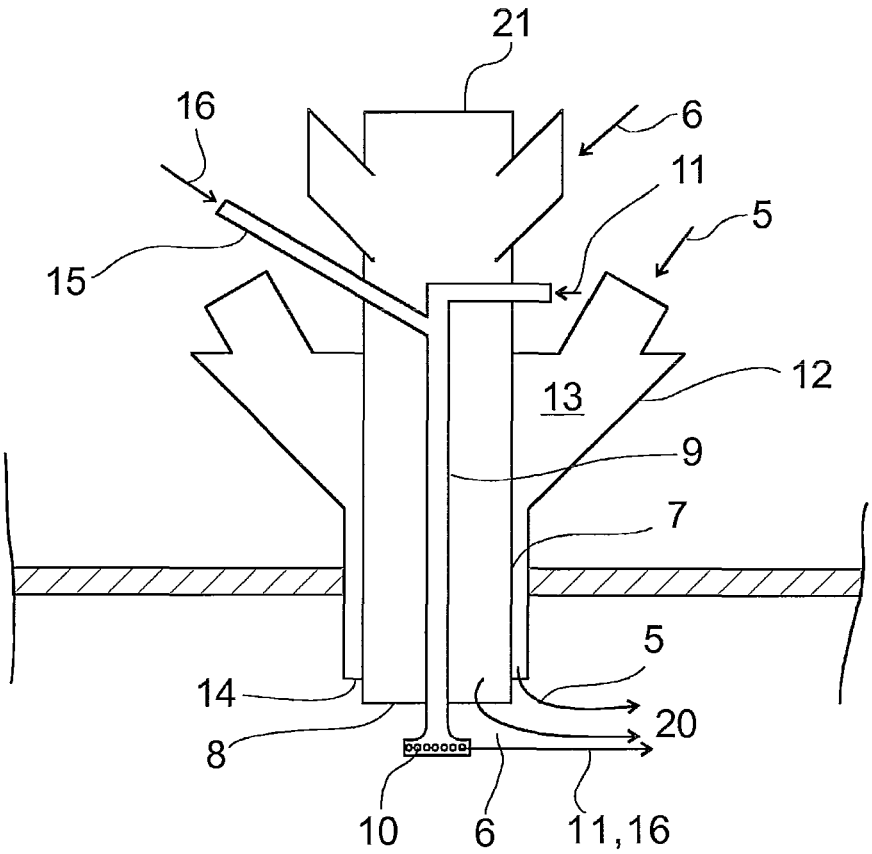
FIG. 2 shows a first preferred embodiment of the concentrate burner according to the invention.

FIG. 2 shows a first preferred embodiment of the concentrate burner 4 according to the invention. In FIG. 2, the fuel gas feeding equipment 15 is arranged to feed fuel gas 16 into the dispersing device 9, so that dispersing gas 11 that is fed through the dispersing gas openings 10 at least partly consists of fuel gas 16. It is also possible to only use fuel gas 16 as dispersing gas 11.

Figure 3:
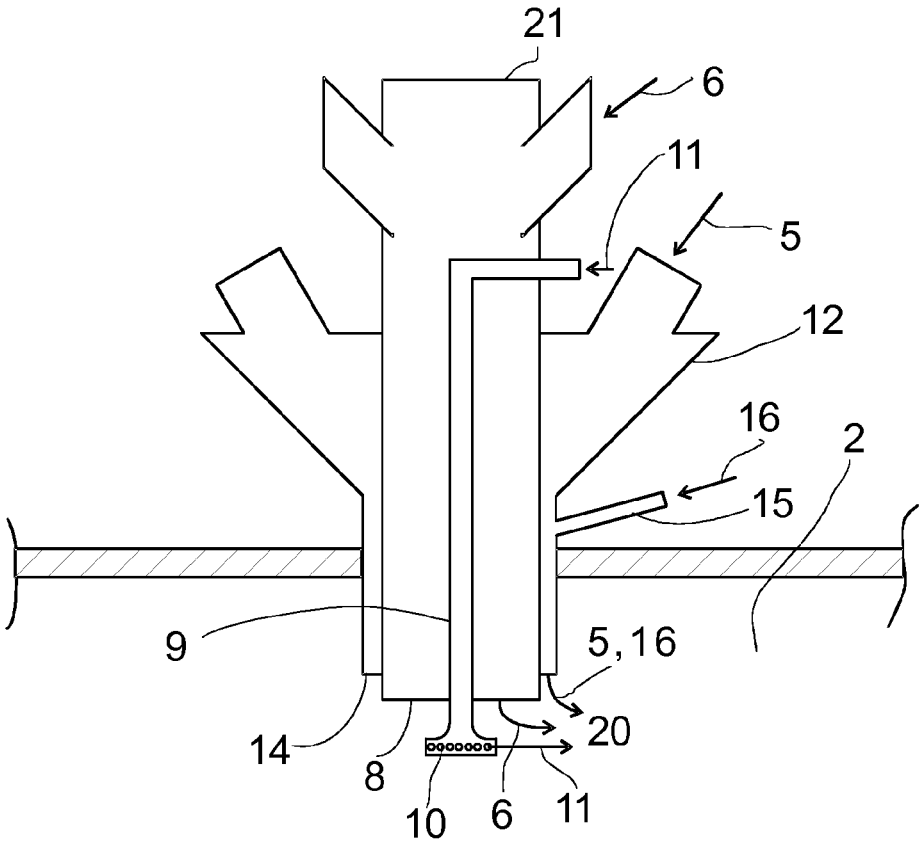
FIG. 3 shows a second preferred embodiment of the concentrate burner according to the invention.

FIG. 3 shows a second preferred embodiment of the concentrate burner 4 according to the invention. In FIG. 2, the fuel gas feeding equipment 15 is arranged so as to feed fuel gas 16 into the gas supply device 12, so that reaction gas 5 that discharges from the discharge opening through the annular discharge opening 14, which concentrically surrounds the feeder pipe 7, contains fuel gas 16.

Figure 4:
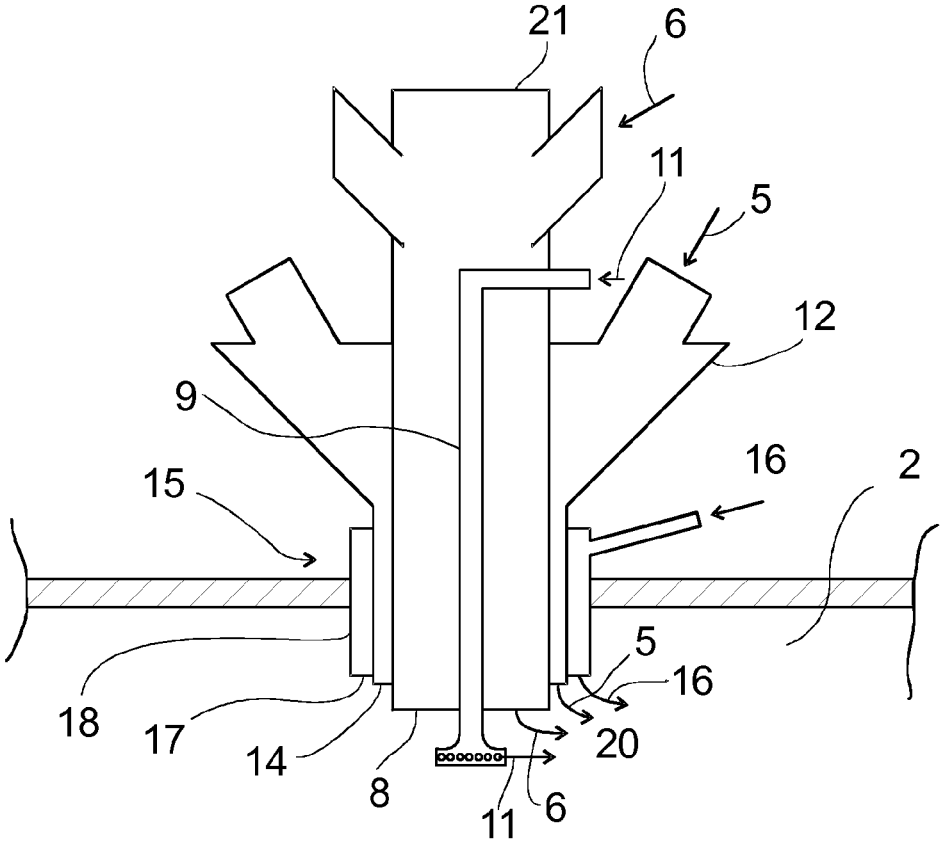
FIG. 4 shows a third preferred embodiment of the concentrate burner according to the invention

FIG. 4 shows a third preferred embodiment of the concentrate burner 4 according to the invention. In FIG. 4, the fuel gas feeding equipment 15 comprises a fuel gas device 18, which is arranged outside the reaction gas chamber 13 of the gas supply device 12 and which comprises a second annular discharge opening 17 for feeding fuel gas 16 through the said second annular discharge opening for mixing fuel gas 16 with mixture of pulverous solid matter 6 and reaction gas 5.

Figure 5:
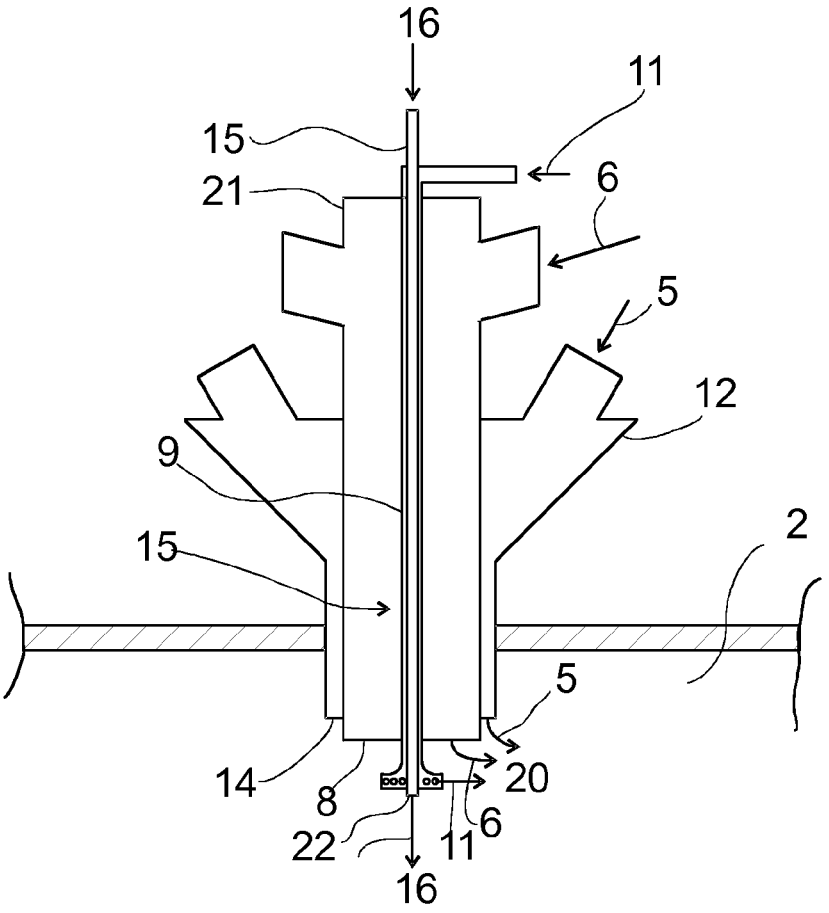
FIG. 5 shows a fourth preferred embodiment of the concentrate burner according to the invention.

FIG. 5 shows a fourth preferred embodiment of the concentrate burner 4 according to the invention. In FIG. 5 the concentrate burner comprises a fuel gas feeding equipment 15 that penetrates the dispersing device 9 and that comprises a discharging opening 22 that opens to the reaction shaft 2 for feeding fuel gas 16 via said discharging opening 22 into the reaction shaft 2 of the suspension smelting furnace for mixing fuel gas 16 into the mixture of fine solid matter 6 and reaction gas 5.

Figure 6:
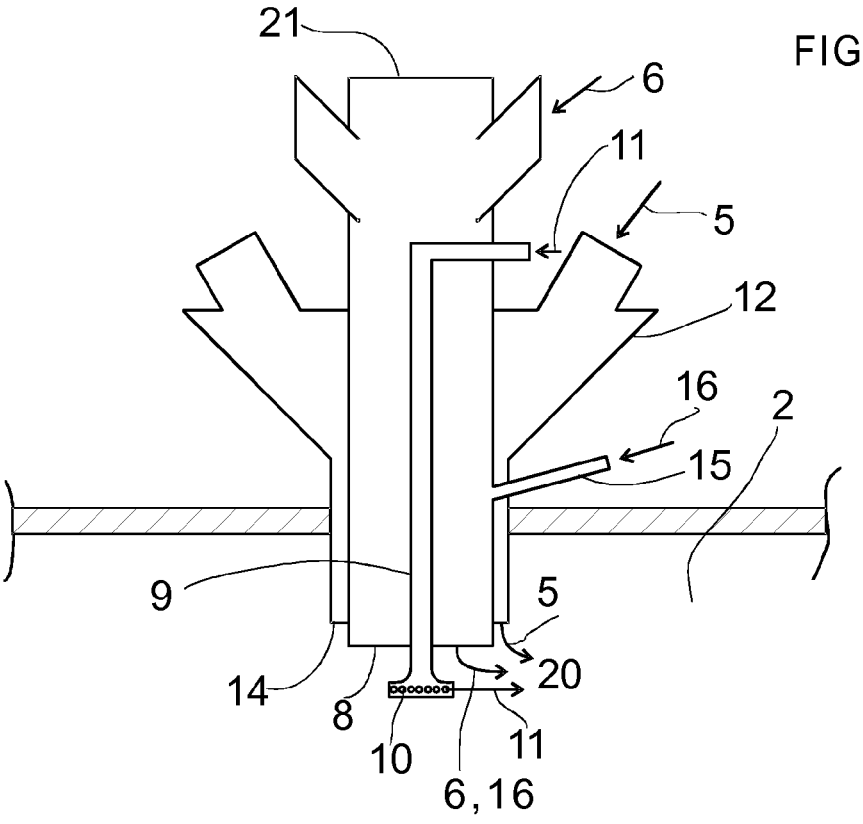
FIG. 6 shows a fifth preferred embodiment of the concentrate burner according to the invention.

FIG. 6 shows a fifth preferred embodiment of the concentrate burner 4 according to the invention. In FIG. 6 fuel gas feeding equipment 15 is arranged so as to feed fuel gas 16 into the fine solid matter supply device 21 such that from the orifice 8 of the feeder pipe is mixture of fine solid matter 6 and fuel gas 16 discharged.

The fuel gas 16 comprises preferably, but not necessarily, at least one of the following: natural gas, propane or butane.

The invention also relates to a method of feeding fuel gas 16 into the reaction shaft 2 of the suspension smelting furnace.

In the method a concentrate burner 4 is used that comprises a fine solid matter supply device 21 for feeding fine solid matter 6 into the reaction shaft 2 and a gas supply device 12 for feeding reaction gas 5 into the reaction shaft 2.

The method comprising feeding fine solid matter 6 into the reaction shaft 2 by means of the fine solid matter supply device 21 and feeding reaction gas 5 into the reaction shaft 2 by means of the gas supply device 12.

In the method fuel gas 16 is fed into the reaction shaft 2 by the concentrate burner 4 to constitute part of the mixture containing fine solid matter 6 and reaction gas 5, so that a mixture containing fine solid matter 6, reaction gas 5 and fuel gas 16 is formed in the reaction shaft 2.

In the method may fuel gas 16 and fine solid matter 6 be mixed on the outside of the reaction shaft 2 such that in that mixture of fuel gas 16 and fine solid matter 6 is fed into the reaction shaft 2.

In the method may fuel gas 16 be fed into the fine solid matter supply device 21 of the concentrate burner 4 such, that fuel gas 16 is mixed into fine solid matter 6 in the fine solid matter supply device 21 of the concentrate burner 4 outside of the reaction shaft 2 resulting in that mixture of fuel gas 16 and fine solid matter 6 is fed into the reaction shaft 2.

In the method fuel gas 16 may be mixed into reaction gas 6 outside of the reaction shaft 2 such that mixture of fuel gas 16 and reaction gas 6 is fed into the reaction shaft 2.

In the method may fuel gas 16 be fed into the gas supply device 12 of the concentrate burner 4 such, that fuel gas 16 is mixed into reaction gas 6 in the gas supply device 12 of the concentrate burner 4 outside of the reaction shaft 2 resulting in that mixture of fuel gas 16 and reaction gas 6 is fed into the reaction shaft 2.

In the method may a concentrate burner 4 be used that comprises a dispersing device 9 for directing a stream of dispersing gas 11 towards fine solid matter 6 in the reaction shaft 2 for directing fine solid matter 6 towards reaction gas 5 in the reaction shaft 2. In such case may fuel gas 16 be fed with the concentrate burner such that fuel gas 16 is mixed into dispersing gas 11 outside of the reaction shaft 2 resulting in that that mixture of fuel gas 16 and dispersing gas 11 is fed into the reaction shaft 2. In such case may additionally or alternatively fuel gas 16 be fed into the dispersing device 9 of the concentrate burner 4 such, that fuel gas 16 is mixed into dispersing gas 11 in the dispersing device 9 outside of the reaction shaft 2 resulting in that that mixture of fuel gas 16 and dispersing gas 11 is fed into the reaction shaft 2.

The method may employ a such concentrate burner 4, which comprises (i) a feeder pipe 7 for feeding the fine solid matter 6 into the reaction shaft 2, where an orifice 8 of the feeder pipe opens to the reaction shaft 2, and which concentrate burner 4 that further comprises (ii) a dispersing device 9, which is arranged concentrically inside the feeder pipe 7 and which extends to a distance from the orifice 8 of the feeder pipe inside the reaction shaft 2 and which comprises dispersing gas openings 10 for directing the dispersing gas 11 around the dispersing device 9 and to fine solid matter 6 that flows around the dispersing device 9, and which concentrate burner 4 further comprises (iii) a gas supply device 12 for feeding reaction gas 5 into the reaction shaft 2, the gas supply device 12 opening to the reaction shaft 2 through the annular discharge opening 14 that surrounds the feeder pipe 7 concentrically for mixing reaction gas 5 that discharges from the annular discharge opening 14 with the fine solid matter 6, which discharges from the middle of the feeder pipe 7 and which is directed to the side by means of dispersing gas 11. Such concentrate burner is shown in FIGS. 2 to 6.

If in the method a concentrate burner of the type as shown in FIGS. 2 to 6 is used, fine solid matter 6 is fed into the reaction shaft 2 through the orifice 8 of the feeder pipe of the concentrate burner 4.

If in the method a concentrate burner of the type as shown in FIGS. 2 to 6 is used, dispersing gas 11 is fed into the reaction shaft 2 through the dispersing gas openings 10 of the dispersing device 9 of the concentrate burner 4 for directing dispersing gas 11 to fine solid matter 6 that flows around the dispersing device 9.

If in the method a concentrate burner of the type as shown in FIGS. 2 to 6 is used, reaction gas 5 is fed into the reaction shaft 2 through the annular discharge opening 14 of the gas supply device of the concentrate burner 4 for mixing reaction gas 5 with fine solid matter 6 that discharges from the middle of the feeder pipe 7, solid matter 6 being directed to the side by means of the dispersing gas 11.

If in the method a concentrate burner of the type as shown in FIGS. 2 to 6 is used, the concentrate burner 4 is used for feeding fuel gas 16 to constitute one component of the mixture formed by pulverous solid matter 6 and reaction gas 5, so that a mixture containing pulverous solid matter 6, reaction gas 5 and fuel gas 16 is formed in the reaction shaft 2.

In a first preferred embodiment of the method according to the invention, fuel gas 16 is fed through the dispersing gas openings 10 of the dispersing device 9 of the concentrate burner 4, so that dispersing gas 11 that is to be fed at least partly consists of fuel gas 16. FIG. 2 shows a concentrate burner 4, which applies the first preferred embodiment of the method according to the invention.

In another preferred embodiment of the method according to the invention, fuel gas 16 is fed into the gas supply device 12 of the concentrate burner 4, so that reaction gas 5 that discharges through the annular discharge opening 14 of the gas supply device, which surrounds the feeder pipe 7 concentrically, contains fuel gas 16. FIG. 3 shows a concentrate burner 4, which applies the second preferred embodiment of the method according to the invention.

In a third preferred embodiment of the method according to the invention, fuel gas feeding equipment 15 is arranged outside the gas supply device 12, comprising a fuel gas supply device 18, which comprises a second annular discharge opening 17, which is concentric with the annular discharge opening 14 of the gas supply device and which opens to the reaction chamber. In this preferred embodiment, fuel gas 16 is fed through the said second annular discharge opening for mixing fuel gas 16 with mixture of the pulverous solid matter 6 and reaction gas 5. FIG. 4 shows a concentrate burner 4, which applies the third preferred embodiment of the method according to the invention.

In a fourth preferred embodiment of the method according to the invention fuel gas feeding equipment 15 is arranged that penetrates the dispersing device 9 and that comprises a discharging opening 22 that opens to the reaction shaft 2. In this preferred embodiment of the method fuel gas 16 is fed via said discharging opening 22 into the reaction shaft 2 of the suspension smelting furnace for mixing fuel gas 16 into the mixture of fine solid matter 6 and reaction gas 5.

In a fourth preferred embodiment of the method according to the invention fuel gas 16 is fed into the feeder pipe 7 such that from the orifice 8 of the feeder pipe is mixture of fine solid matter 6 and fuel gas 16 discharged.

In the method according to the invention, as fuel gas 16 is preferably, but not necessarily, used at least one of the following: natural gas, propane and butane.

The method and the concentrate burner may be used in the start-up of a suspension smelting furnace for example after a production break.

The method and the concentrate burner may be used in the start-up of a suspension smelting furnace for example after a production break so that the use comprises a step for feeding solely reaction gas 6 and fuel gas 16 into the reaction shaft 2.

The method and the concentrate burner may be used for maintaining the temperature in a suspension smelting furnace for example during a production break.

The method and the concentrate burner may be used for maintaining the temperature in a suspension smelting furnace for example a production break so that the use comprises a step for feeding solely reaction gas 6 and fuel gas 16 into the reaction shaft 2.

It is obvious to those skilled in the art that with the technology improving, the basic idea of the invention can be implemented in various ways. Thus, the invention and its embodiments are not limited to the examples described above but they may vary within the claims.

The invention claimed is:

1. A method of feeding a fuel gas into a reaction shaft of a suspension smelting furnace, the method comprising feeding fine solid matter into the reaction shaft of the suspension smelting furnace through an orifice of a feeder pipe of a fine solid matter supply device of a concentrate burner, wherein the orifice opening up into the reaction shaft of the suspension smelting furnace;

feeding dispersion gas into the reaction shaft of the suspension smelting furnace through a dispersing device of the concentrate burner, wherein the dispersing device being arranged concentrically inside the feeder pipe of the fine solid matter supply device of the concentrate burner, wherein the dispersing device extending a distance from the orifice of the feeder pipe of the fine solid matter supply device of the concentrate burner inside the reaction shaft of the suspension smelting furnace, and wherein the dispersing device comprising dispersion gas openings configured to feed dispersing gas around the dispersing device to fine solid matter that flows from the orifice of the feeder pipe of the fine solid matter supply device of the concentrate burner around the dispersing device to direct said fine solid matter that flows around the dispersing device radially outwards;

feeding reaction gas into the reaction shaft of the suspension smelting furnace from an annular discharge opening of a reaction gas chamber of a gas supply device of the concentrate burner, wherein the reaction gas chamber is arranged outside the reaction shaft of the suspension smelting furnace and wherein the reaction gas chamber opens to the reaction shaft of the suspension smelting furnace through the annular discharge opening, which concentrically surrounds the feeder pipe of the fine solid matter supply device of the concentrate burner to mix reaction gas with fine solid matter, which is fed from the orifice of the feeder pipe of the fine solid matter supply device of the concentrate burner and which is directed radially outwards by means of dispersing gas fed from the dispersion gas openings of the dispersing device of the concentrate burner; and feeding fuel gas by means of fuel gas feeding equipment into the dispersing device of the concentrate burner to mix fuel gas into dispersing gas in the dispersing device outside of the reaction shaft so that dispersion gas that is fed from the openings of the dispersing device at least partly consists of fuel gas.

2. The method according to claim 1, wherein as fuel gas is natural gas, propane or butane.

3. The method according to claim 1, comprising a step for feeding solely reaction gas and fuel gas into the reaction shaft of the suspension smelting furnace.

* * * * *